US010288239B2

(12) United States Patent
Lee et al.

(10) Patent No.: US 10,288,239 B2
(45) Date of Patent: May 14, 2019

(54) LAMP DEVICE

(71) Applicant: ELEMENTS PERFORMANCE MATERIALS LIMITED, Kaohsiung (TW)

(72) Inventors: Tsung-Lung Lee, Kaohsiung (TW); Kuo-Sung Huang, Kaohsiung (TW); Jerryson Lee, Kaohsiung (TW)

(73) Assignee: ELEMENTS PERFORMANCE MATERIALS LIMITED, Kaohsiung (TW)

( * ) Notice: Subject to any disclaimer, the term of this patent is extended or adjusted under 35 U.S.C. 154(b) by 0 days.

(21) Appl. No.: 16/027,297

(22) Filed: Jul. 4, 2018

(65) Prior Publication Data

US 2019/0011097 A1 Jan. 10, 2019

(30) Foreign Application Priority Data

Jul. 5, 2017 (TW) ..... 106122554 A

(51) Int. Cl.

| | |
|---|---|
| ***F21S 8/00*** | (2006.01) |
| ***F21V 17/06*** | (2006.01) |
| ***F21V 17/12*** | (2006.01) |
| ***F21V 19/00*** | (2006.01) |
| ***F21V 21/02*** | (2006.01) |
| ***F21V 21/30*** | (2006.01) |
| ***F21Y 115/10*** | (2016.01) |

(52) U.S. Cl.

CPC ..... *F21S 8/03* (2013.01); *F21V 17/06* (2013.01); *F21V 17/12* (2013.01); *F21V 19/0035* (2013.01); *F21V 21/025* (2013.01); *F21V 21/30* (2013.01); *F21Y 2115/10* (2016.08)

(58) Field of Classification Search

CPC .... F21V 21/025; F21V 21/005; F21V 19/003; F21V 19/0045; F21V 19/0035; F21V 17/06; F21V 17/12

See application file for complete search history.

(56) References Cited

U.S. PATENT DOCUMENTS 6,220,721 B1 * 4/2001 Chan ..... F21S 2/00 362/219
2011/0310604 A1 * 12/2011 Shimizu ..... F21V 15/015 362/235

(Continued)

*Primary Examiner* — William N Harris
(74) *Attorney, Agent, or Firm* — Li & Cai Intellectual Property (USA) Office

(57) ABSTRACT

A lamp device includes a shell and a light-emitting module. The shell has two guiding fastener members opposite to each other. The light-emitting module includes a carrier board body, fastening members, light-emitting assemblies, and a light-permeable shield module. One side of the carrier board body has two opposite connecting members. The carrier board body is connected with the two guiding fastener members through the connecting members to move relative to the shell along the guiding fastener members. The carrier board body has fastening holes cooperating with the fastening members so that the carrier board body and the guiding fastener members are fastened to each other. The light-emitting assemblies and the light-permeable shield module are fixedly disposed on one side of the carrier board body. The light-permeable shield module does not protrude from the ends of two side walls of the shell that are away from a top wall.

10 Claims, 10 Drawing Sheets

(56) References Cited

U.S. PATENT DOCUMENTS

| | | | | |
|---|---|---|---|---|
| 2013/0039052 | A1* | 2/2013 | Forteza | F21V 19/00 362/223 |
| 2013/0058091 | A1* | 3/2013 | Hast | F21V 17/162 362/249.04 |
| 2018/0231196 | A1* | 8/2018 | Gantenbrink | F21S 8/038 |
| 2018/0252376 | A1* | 9/2018 | Hierzer | F21S 8/04 |
| 2019/0032871 | A1* | 1/2019 | Bechter | F21V 31/005 |

* cited by examiner

LAMP DEVICE

CROSS-REFERENCE TO RELATED PATENT APPLICATION

This application claims the benefit of priority to Taiwan Patent Application No. 106122554, filed on Jul. 5, 2017. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a lamp device, and more particularly to a lamp device whose light-emitting module has a relative height that is adjustable according to needs.

BACKGROUND OF THE DISCLOSURE

A light-emitting module of a common lamp device used in an office or factory, especially that of a light-emitting diode lamp device, cannot be easily changed, as the lamp device is usually designed to be an integral piece. Therefore, a user cannot merely replace a light-emitting module therein when the light-emitting module is broken. Rather, the entire device must be replaced. Also, a user cannot change the type (e.g., for different brightness) of the light modules according to requirements, which may cause practical inconvenience for a user.

SUMMARY OF THE DISCLOSURE

In response to the above-referenced technical inadequacies, the present disclosure provides a lamp device.

In one aspect, the present disclosure provides a lamp device including a shell, two guiding fastener members and at least one light-emitting module. The shell has a top wall and two side walls. The top wall has two opposite side edges. The two side walls are disposed respectively at the two opposite side edges of the top wall, and are opposite to each other. Each side wall has a surface facing the other side wall. The two guiding fastener members are respectively disposed at the two surfaces of the two side walls. Each of the two guiding fastener members is a long-strip board structure. The at least one light-emitting module is selectively and fixedly disposed in the shell. The light-emitting module can move along a central axis of the two guiding fastener members. The light-emitting module includes a carrier board body, two connecting members, a plurality of fastening members, a plurality of light-emitting assemblies, and at least one light-permeable shield module. The carrier board body has two opposite side edges, a plurality of fastening holes formed on each of the two side edges of the carrier board body, and a wide lateral surface. The two connecting members are formed on the wide lateral surface. The two connecting members extend along a direction away from the carrier board body, and are respectively disposed adjacent to the two side edges of the carrier board body.

Each connecting member has a connecting portion and a supporting portion. The connecting portion can move relative to the shell along the central axis of the two guiding fastener members. The supporting portion is connected with a corresponding guiding fastener member, and has two ends respectively connected with the wide lateral surface and the connecting portion. The fastening members are correspondingly fastened in the fastening holes. Each fastening member has an end which can, when the fastening member is fastened in a corresponding fastening hole, abut against a surface facing away from the top wall of a corresponding guiding fastener member, so that the carrier board body is fixedly disposed in the shell. The light-emitting assemblies are fixedly disposed on a first surface of the carrier board body opposite to a second surface of the carrier board body where the connecting members are disposed. The at least one light-permeable shield module is fixedly disposed on the first surface of the carrier board body where the light-emitting assemblies are disposed, and can correspondingly shield the light-emitting assemblies. When the connecting portions of the connecting members are connected with the guiding fastener members, the guiding fastener members shield the fastening holes.

In one aspect, the present disclosure provides a lamp device including a shell, two guiding fastener members and at least one light-emitting module. The shell has a top wall and two side walls. The top wall has two opposite side edges. The two side walls are disposed respectively at the two opposite side edges of the top wall, and are opposite to each other. Each side wall has a surface facing the other side wall. The two guiding fastener members are respectively disposed at the two surfaces of the two side walls. Each of the two guiding fastener members is a long-strip board structure. The at least one light-emitting module is selectively and fixedly disposed in the shell. The light-emitting module can move along a central axis of the two guiding fastener members. The light-emitting module includes a carrier board body, two connecting members, a plurality of light-emitting assemblies, and at least one light-permeable shield module. The carrier board body has two opposite side edges, and a wide lateral surface. The two connecting members are formed on the wide lateral surface. The two connecting members extend along a direction away from the carrier board body, and are respectively disposed adjacent to the two side edges of the carrier board body. Each connecting member has a connecting portion and a supporting portion. The connecting portion can move relative to the shell along the central axis of the two guiding fastener members. The supporting portion is connected with a corresponding guiding fastener member, and has two ends respectively connected with the wide lateral surface and the connecting portion. The light-emitting assemblies are fixedly disposed on a surface of the carrier board body opposite to a surface of the carrier board body where the connecting members are disposed. The at least one light-permeable shield module is fixedly disposed on the surface of the carrier board body where the light-emitting assemblies are disposed, and can correspondingly shield the light-emitting assemblies. The two connecting portions of the connecting members are correspondingly fastened with the guiding fastener members through a gluing member (or a screw).

Therefore, through the mutual cooperation between the guiding fastener members of the shell and the carrier board body of the light-emitting module, and between fastening members and fastening holes of the carrier board body, a user can replace the light-emitting module disposed in the shell quickly and conveniently, without needing to replace the entire lamp device. Further, when replacing the light-emitting module, the user can replace the light-emitting module without needing to detach the shell.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
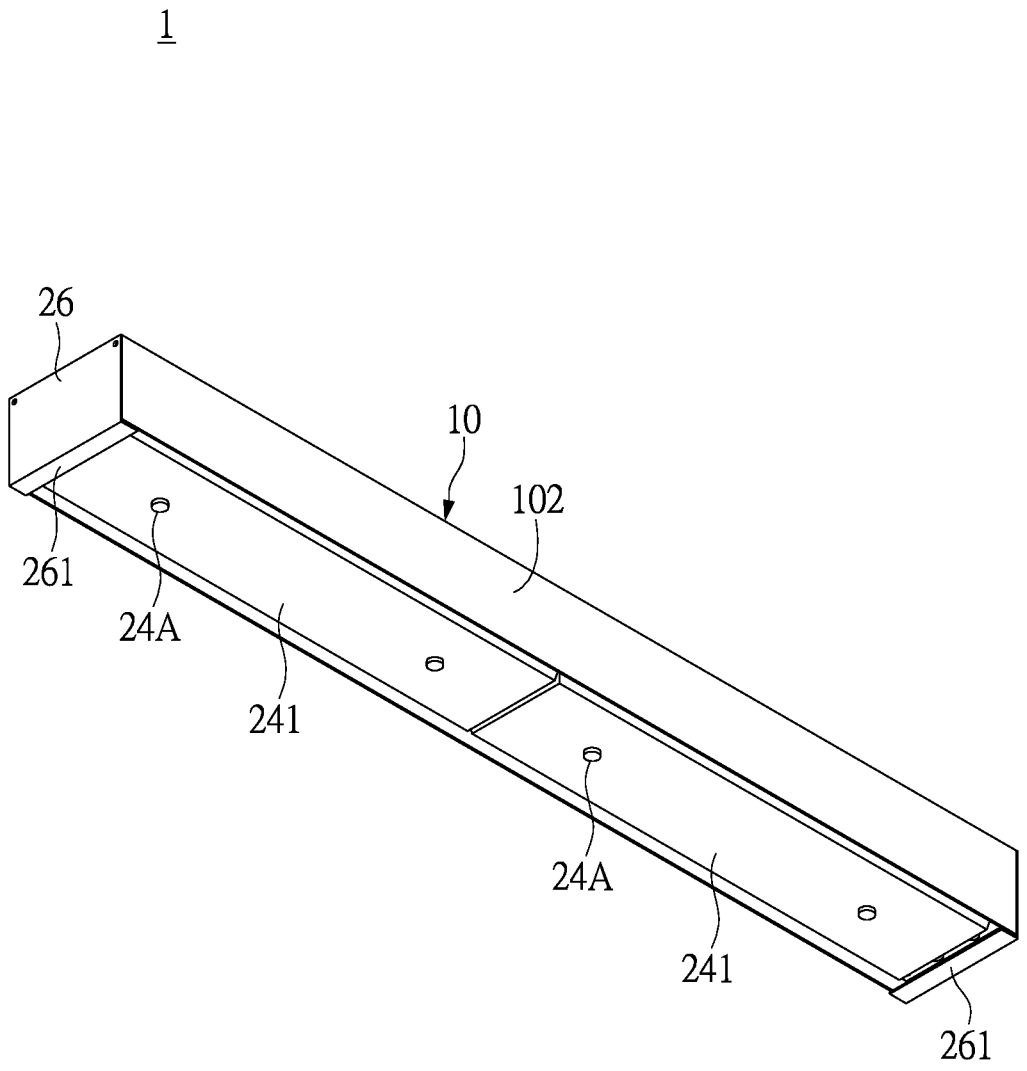
FIG. 1 is a schematic diagram of a lamp device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
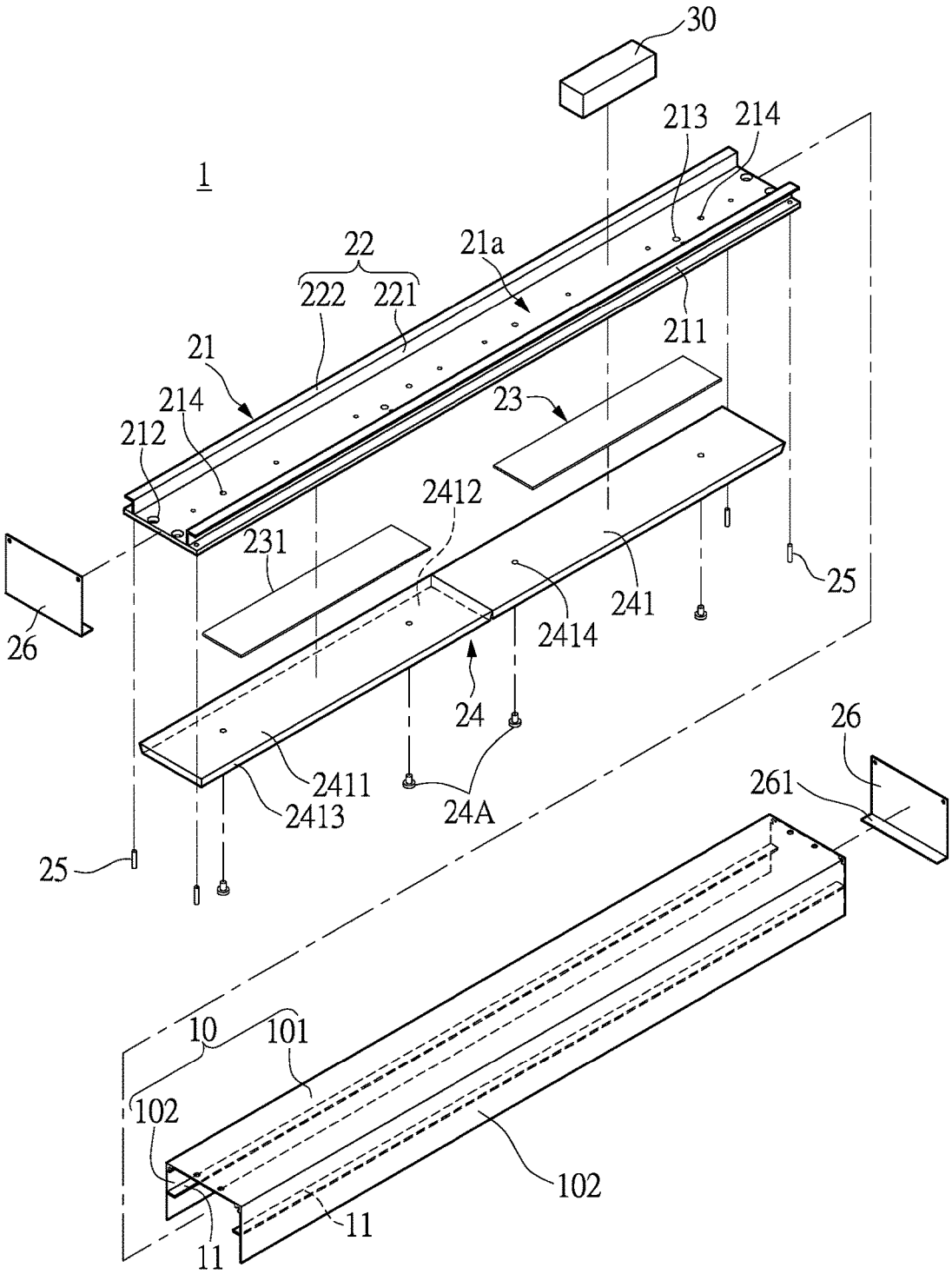
FIGS. 2 and 3 are exploded views of the lamp device according to the first embodiment of the present disclosure.
Figure 3:
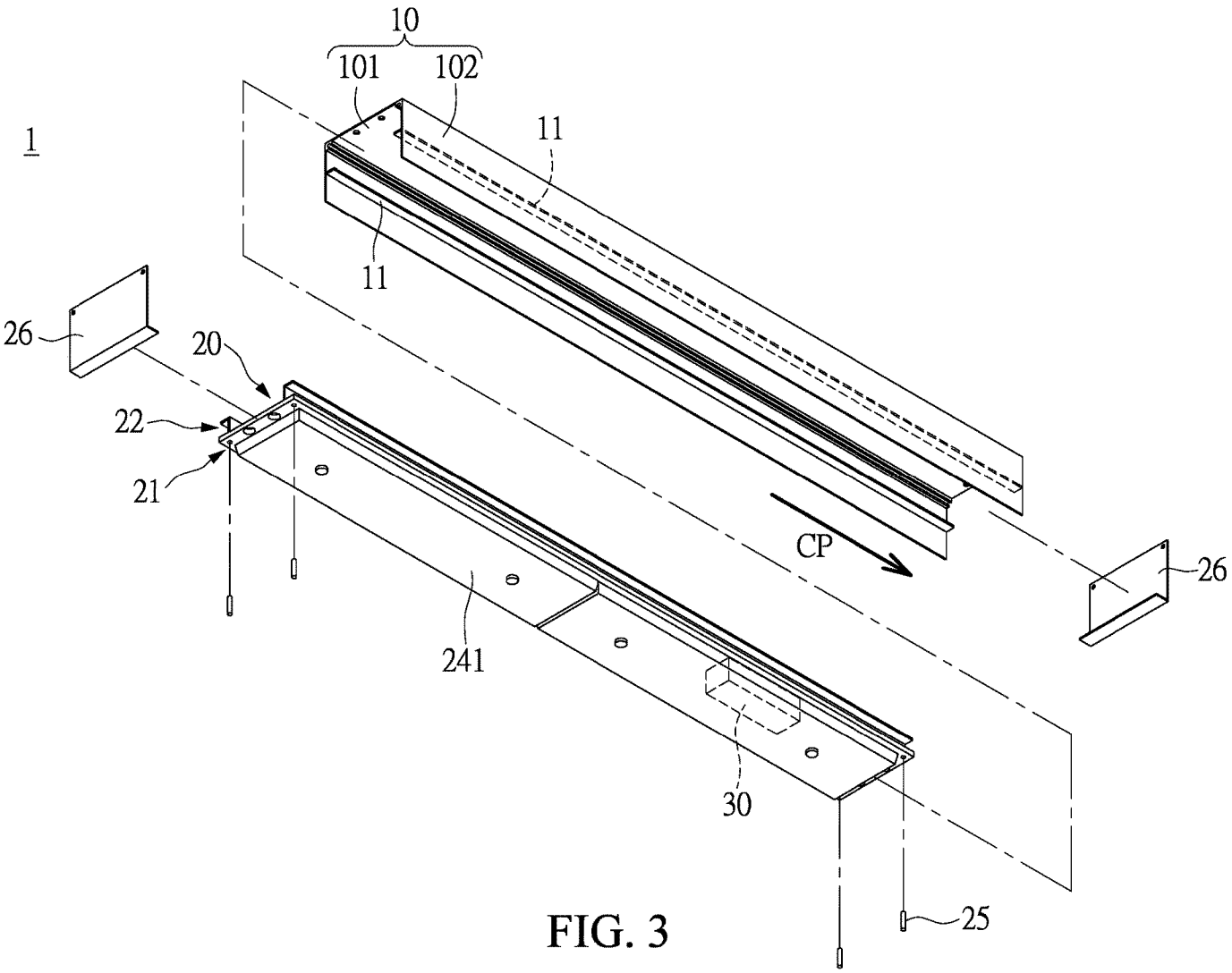

Reference is made to FIG. 1 to FIG. 3, which are assembled and exploded views of a lamp device of the present disclosure. As shown in the figures, a lamp device 1 includes a shell 10 and a light-emitting module 20 (the number of the light-emitting module 20 can be changed according to requirements, which can be one or more than one). The light-emitting module 20 can be selectively and fixedly disposed in the shell 10, and the light-emitting module 20 can be fixedly disposed in the shell 10. In certain embodiments, the shell 10 is fixed on a ceiling (or any wall surface). In certain embodiments, the shell 10 can be made of a material with high thermal conductivity, and can be integrally formed. For example, the shell 10 can be made of extruded aluminum.

Further, the shell 10 includes a top wall 101 and two side walls 102. The two side walls 102 are respectively connected with two opposite sides of the top wall 101. The top wall 101 and the two side walls 102 collectively can be in a shape similar to an inverted U. A surface of each of the two side walls 102 facing the other side wall 102 extends along a direction toward the other side wall to form a guiding fastener member 11. The two guiding fastener members 11 are arranged opposite to each other. Each guiding fastener member 11 can be substantially located in the middle of a surface of a corresponding side wall 102 and adjacent to the top wall 101. However, the present disclosure is not limited thereto. In certain embodiments, each guiding fastener member 11 is a board structure, and the distance between each guiding fastener member 11 and the top wall 101 is not greater than the distance between the guiding fastener member 11 and an end away from the top wall 101 of the side wall 102 to which the guiding fastener member 11 is connected. In certain embodiments, the guiding fastener members 11 can be manufactured integrally with the shell 10, for example, through aluminum extrusion.

Figure 4:
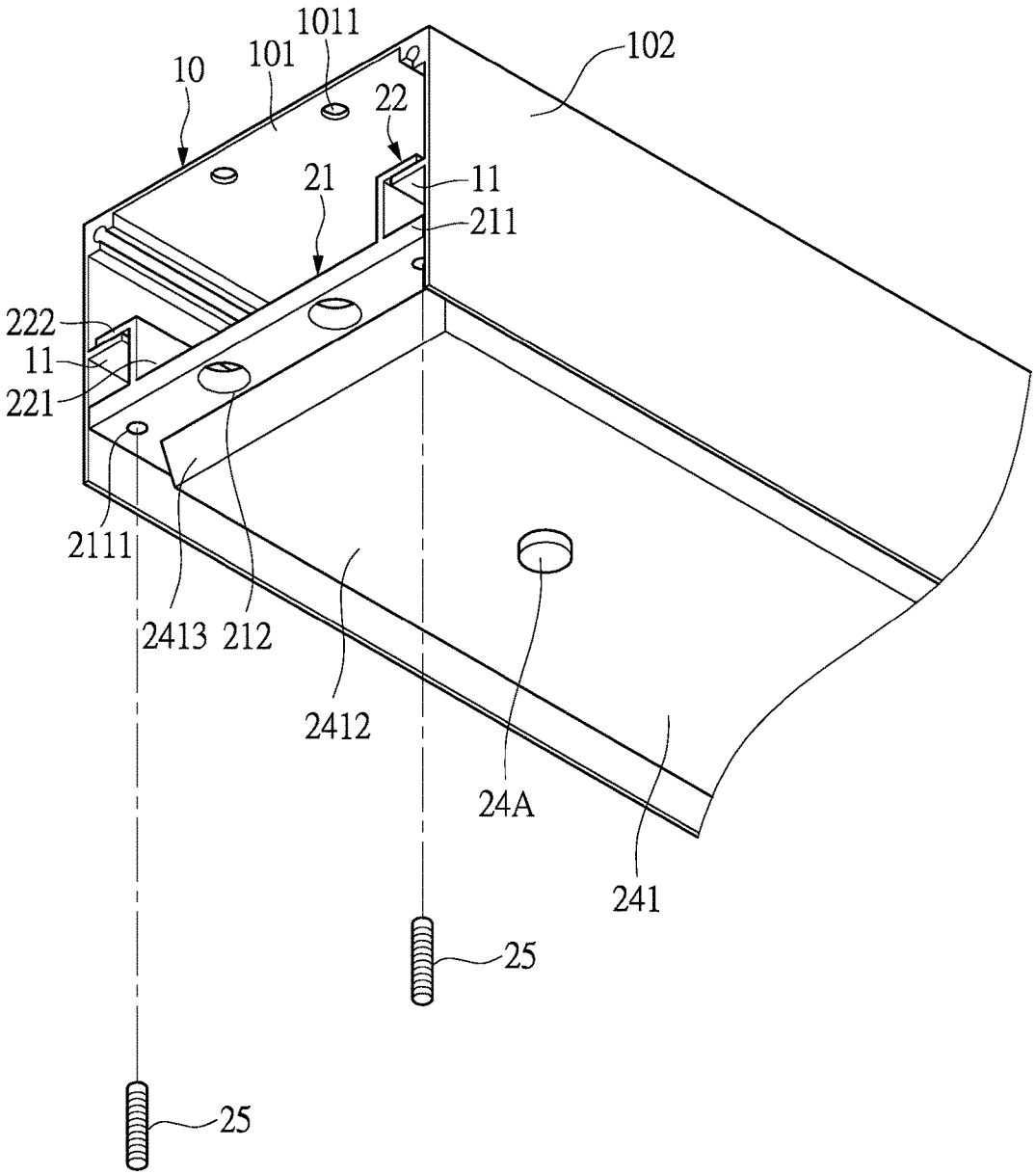
FIGS. 4-6 are partially enlarged views of the lamp device according to the first embodiment of the present disclosure.

As shown in FIG. 2 to FIG. 4, the light-emitting module 20 includes a carrier board body 21, two connecting members 22, two light-emitting assemblies 23, a light-permeable shield module 24, and a plurality of fastening members 25. A wide lateral surface 21*a* of the carrier board body 21 extends in a direction away from the carrier board body 21 to form the two connecting members 22. The two connecting members 22 are disposed adjacent to two opposite side edges of the carrier board body 21. Each connecting member 22 has a supporting portion 221 and a connecting portion 222. The two ends of the supporting portion 221 of each connecting member 22 are respectively connected with the wide lateral surface 21*a* and the connecting portion 222 of the carrier board body 21. Specifically, each connecting member 22 can substantially be in the shape of an inverted L, and correspondingly disposed to the wide lateral surface 21*a* of the carrier board body 21. Two mounting portions 211 are respectively formed between each of the two side edges of the carrier board body 21 adjacent to a corresponding connecting member 22 and the corresponding connecting member 22. Each of the mounting portions 211 is formed with at least one fastening hole 2111 adjacent to a connecting member 22 corresponding to the mounting portion 211.

Each of the two light-emitting assemblies 23 includes a substrate 231 and a plurality of light-emitting units (not shown, for example, light-emitting diodes). The light-emitting units are disposed on the substrate 231. A surface of the substrate 231 opposite to the other surface thereof where the light-emitting units are disposed is correspondingly disposed on a surface of the carrier board body 21 opposite to the other surface thereof where the connecting members 22 are disposed. In certain embodiments, the substrate 231 can be fixed on the carrier board body 21 through screws or other kinds of fasteners. In certain embodiments, the substrate 231 can also be fixed on the carrier board body 21 by gluing. However, the present disclosure is not limited thereto. In certain embodiments, the carrier board body 21 can be made of a heat-conducting material, and the heat energy generated by the operation of the light-emitting assemblies 23 can be conducted away through the carrier board body 21.

The light-permeable shield module 24 corresponds to the two light-emitting assemblies 23 and can include two lens units 241. Each lens unit 241 can be fixedly disposed on a side of the carrier board body 21 not provided with the connecting members 22. Each lens unit 241 includes a light incident surface 2411, a light emergent surface 2412, and an annular side wall 2413. The light incident surface 2411 is the surface of the light-permeable shield module 24 correspondingly facing and covering the light-emitting assemblies 23, and the light emergent surface 2412 is the surface opposite to the light incident surface 2411. The annular side wall 2413 is connected with the light incident surface 2411 and the light emergent surface 2412.

In certain embodiments, the area of the light incident surface 2411 can be larger than the area of the light emergent surface 2412. The ring side wall 2413 can be obliquely connected with the light incident surface 2411 and the light emergent surface 2412. In other words, each lens unit 241 can be a cut-off quadrangular pyramid structure in the shape of a long strip. In this way, the light emitted by the light-emitting assemblies 23 can be effectively concentrated at and emerge from the light emergent surface 2412. Therefore, the light emitted by the light-emitting assemblies 23 can be effectively utilized. In particular, in certain embodiments, the light-permeable shield module 24 can also be any light-permeable structure and is not limited to a lens. In certain embodiments, the light emergent surfaces 2412 of the lens units 241 correspondingly disposed on the carrier board body 21 are not exposed from a plane defined by the ends away from the top wall 101 of the side walls 102 of the shell 10. However, the present disclosure is not limited thereto. In certain embodiments, the light emergent surfaces 2412 are not exposed from a plane defined by the ends away from the top wall 101 of the side walls 102 of the shell 10, or the light emergent surfaces 2412 can be flush with the end of each side wall 102 of the shell 10 away from the top wall 101.

It should be mentioned that, in certain embodiments, each lens unit 241 can include a plurality of mounting holes 2414 penetrating the lens unit 241, and the lens units 241 can be fastened through a plurality of mounting members 24A and the mounting holes 2414 on the carrier board body 21. In this way, an end of each mounting member 24A away from the lens units 241 (the mounting members 24A are correspondingly fastened to the lens units 241) is correspondingly exposed on the light emergent surface 2412 of the lens unit 241, so that a user or a manufacturer can quickly and conveniently mount the lens units 241 on the carrier board body 21. In the figures of the present embodiment, one end of a mounting member 24A being correspondingly protruded from a light emergent surface 2412 of a lens unit 241 is for illustration purpose only, and the present disclosure is not limited thereto. The end of a mounting member 24A away from a lens unit 241 can also be arranged flush with the light emergent surface 2412 of the lens unit 241. In other words, the end of the mounting member 24A away from the lens unit 241 can be protruding from, recessed on or flush with the light emergent surface 2412 of the lens unit 241 as required. In certain embodiments, the lens units 241 are formed with a first plurality of mounting holes 2414 corresponding to a second plurality of mounting holes 214 formed on the carrier board body 21, and the mounting members 24A are configured to cooperate with the first and second pluralities of mounting holes 2414 and 214 to fix the lens units 241 on the carrier board body 21.

When the light-emitting assemblies 23 and the light-permeable shield module 24 are correspondingly disposed on a surface of the carrier board body 21 opposite to the surface thereof having the connecting members 22, each connecting member 22 on the carrier board body 21 can be correspondingly hung on a side of a corresponding guiding fastener member 11 of the shell 10. The light-emitting module 20 can move relative to the shell 10 along a central axis CP of the two guiding fastener members 11 accordingly. It is particularly emphasized that in the present embodiment, the guiding fastener members 11 and the connecting portions 222 are only exemplified as being board structures, and a connection relationship therebetween is only exemplified as being abutment for illustration purpose, and the present disclosure is not limited thereto. In certain embodiments, the connection between the guiding fastener members 11 and the connecting portions 222 can be performed by any other structure that can slide relative to each other. For example, the guiding fastener members 11 can be a guiding track structure, and the connecting portions 222 can be a structure that can correspondingly slide in the guiding track structure.

Figure 5:
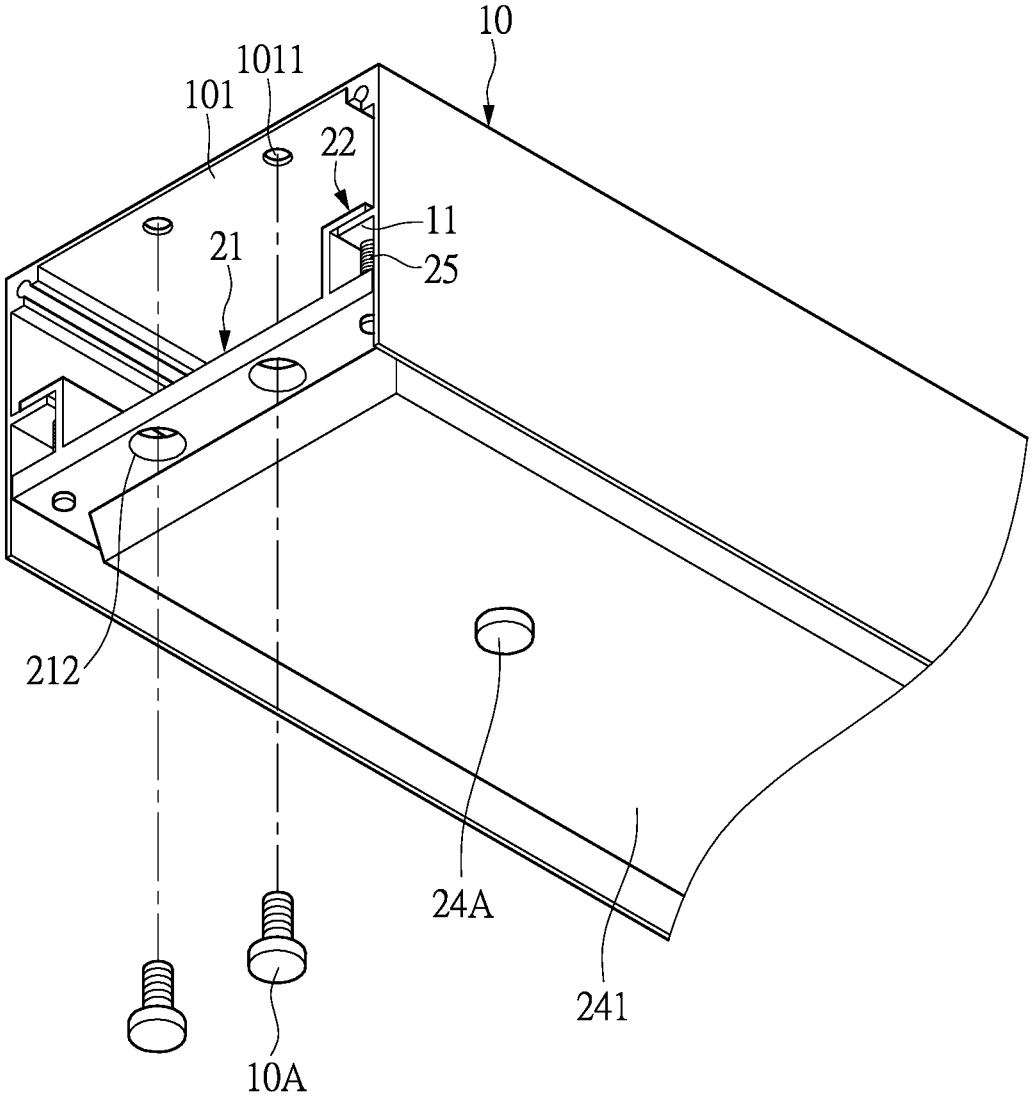

More specifically, referring both to FIG. 4 and FIG. 5, when the light-emitting module 20 is disposed in the shell 10, the connecting portion 222 of each connecting member 22 correspondingly abuts against a surface facing the top wall 101 of a corresponding guiding fastener member 11. Therefore, the two connecting portions 222 of the connecting members 22 can correspondingly slide on the two guiding fastener members 11. In certain embodiments, the width of each guiding fastener member 11 is not less than one half of the width of a corresponding connecting portion 222, so that each connecting portion 222 can firmly abut against a corresponding guiding fastener member 11. In certain embodiments, the two connecting portions 222 respectively abut against the sides of the two guiding fastener members 11, and are correspondingly fastened in the fastening holes 2111 through a plurality of fastening members 25. An end of each fastening member 25 correspondingly fastened in a fastening hole 2111 abuts correspondingly against a surface facing away from the top wall 101 of a corresponding guiding fastener member 11, so that the carrier board body 21 is fixedly disposed inside the shell 10. In certain embodiments, a fastening member 25 can be a set screw, and a fastening hole 2111 can correspondingly be a screw hole. However, the present disclosure is not limited thereto. In certain embodiments, the fastening members 25 can be ordinary screws.

Specifically, in certain embodiments, the light-emitting module 20 is disposed in the shell 10, and when the connecting portions 222 are correspondingly connected with the guiding fastener members 11. Each connecting portion 222 correspondingly abuts against a surface of a corresponding guiding fastener member 11, and the guiding fastener member 11 correspondingly shields a corresponding fastening hole 2111, so that an end of the fastening member 25 can effectively abut against a surface of the guiding fastener member 11. Therefore, the connection strength between the light-emitting module 20 and the shell 10 can be enhanced.

As shown in FIG. 5, when the light-emitting module 20 is fixedly disposed in the shell 10 through the fastening members 25, a user can fix the shell 10 and the light-emitting module 20 disposed therein on a surface (not shown, for example, a ceiling) according to requirements. Specifically, the top wall 101 of the shell 10 can have a plurality of top wall fastening holes 1011. The top wall fastening holes 1011 are respectively disposed adjacent to the two ends of the top wall 101. Each of both ends of the carrier board body 21 have a plurality of avoidance holes 212 corresponding to the top wall fastening holes 1011. In this way, when the light-emitting module 20 is fixedly disposed in the shell 10, a plurality of fastening members 10A can pass through the avoidance holes 212 and be correspondingly fastened in the top wall fastening holes 1011, so that the shell 10 can be fixed on, for example, a ceiling. In certain embodiments, the carrier board body 21 is not formed with the avoidance holes 212 corresponding to the top wall fastening holes 1011, that is, the present disclosure is not limited to any specific arrangement of the avoidance holes 212.

Through the structural design of the top wall fastening holes 1011 and the avoidance holes 212 as shown in the figures, the assembly of the lamp device 1 can be effectively made convenient and intuitive. In particular, a user can first dispose the light-emitting module 20 in the shell 10, and then fasten the shell 10 on a ceiling through the avoidance holes 212. In certain embodiments, the user can also directly fix the shell 10 without the light-emitting module 20 disposed therein to the ceiling. Then, the light-emitting module 20 is slidably disposed in the shell 10 from one end of the shell 10. That is, the assembly of the lamp device 1 of the present disclosure is convenient and is not limited to any specific order of assembling steps.

As described above, referring also to FIG. 4, in the lighting device 1 of the present disclosure, the light-emitting module 20 is slidable relative to the shell 10. The fastening members 25 are fastened in the fastening holes 2111 of the carrier board body 21 of the light-emitting module 20. The fixation of the light-emitting module 20 to the guiding fastener members 11 of the shell 10 is achieved by one end of each fastening member 25 fastened in a corresponding fastening hole 2111 being abutted against a corresponding guiding fastener member 11. Therefore, a manufacturer or a user can easily slide the light-emitting module 20 in the shell 10 through the two guiding fastener members 11 by negating the abutment of the end of each fastening member 25 against a corresponding guiding fastener member 11, so that the light-emitting module 20 can be easily removed from the shell 10. In addition, since the fastening members 25 are correspondingly fastened in the fastening holes 2111, when a user removes the light-emitting module 20, the fastening members 25 no longer abutting against the guiding fastener member 11 are correspondingly fastened in the fastening holes 2111 without falling directly, which facilitates the disassembly work of a user.

Figure 6:
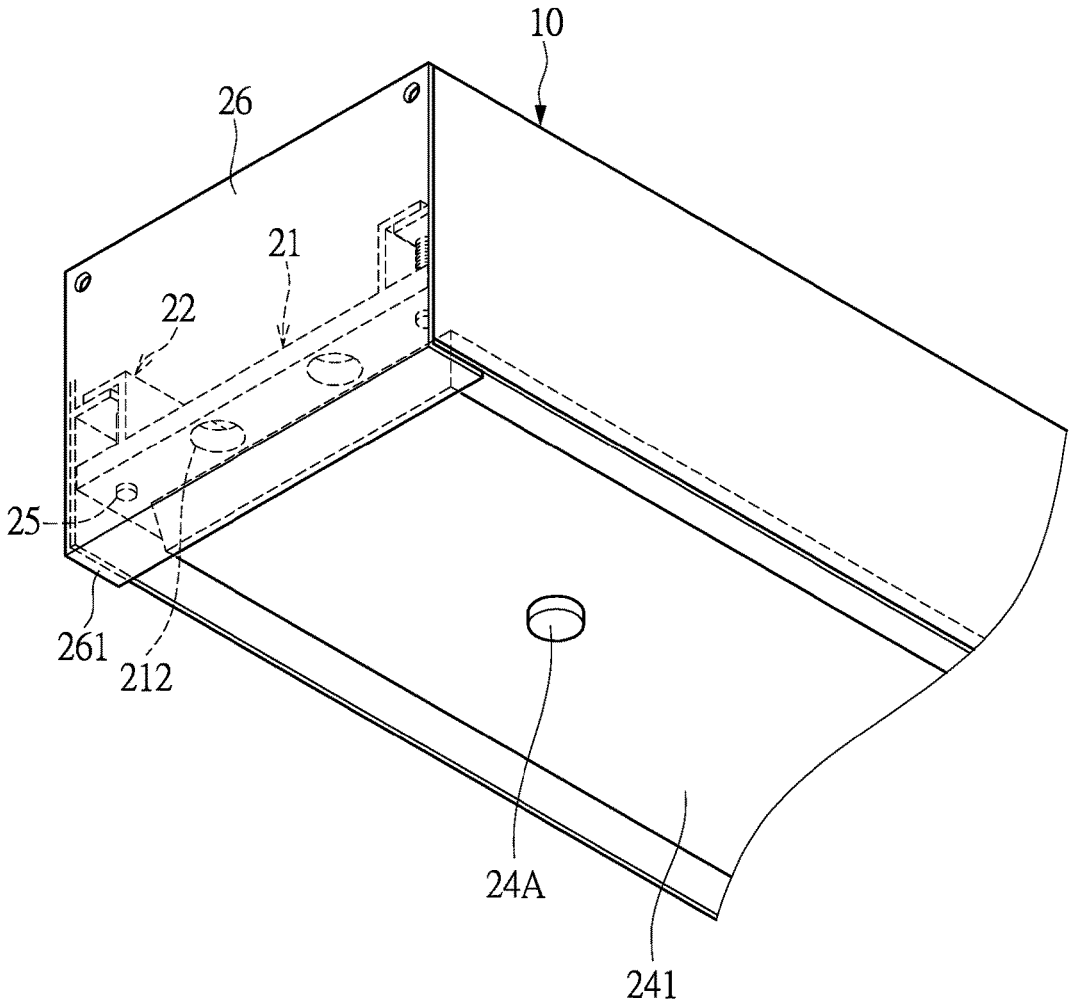

Referring both to FIG. 3 and FIG. 6, the lamp device 1 further includes two end caps 26. The two end caps 26 can be correspondingly disposed at two ends of the shell 10, and each end cap 26 has a shielding portion 261. When both end caps 26 are fixedly disposed at both ends of the shell 10, respectively, the two shielding portions 261 correspondingly shield the adjacent avoidance holes 212 and the fastening members 25, thereby achieving aesthetic effects and avoiding the problem of component damage. The shielding portions 261 do not correspond to the light emergent surfaces 2412 of the light-permeable shield module 24.

As shown in FIG. 5 and FIG. 6, a user or a manufacturer can fix the light-emitting module 20 in the shell 10, and after the shell 10 is fixed to the ceiling, the two end caps 26 can be fixedly disposed at two ends of the shell 10 to complete the assembly of the lamp device 1. In certain embodiments, the end caps 26 can be fixed at both ends of the shell 10 by means of clamping, locking, or the like. However, the present disclosure is not limited thereto. In certain embodiments, the lamp device 1 either includes no end caps 26, or an end cap 26 can be formed at one end of the shell 10 by the direct extension of the end, rather than being detachably disposed on the end of the shell 10.

Figure 7:
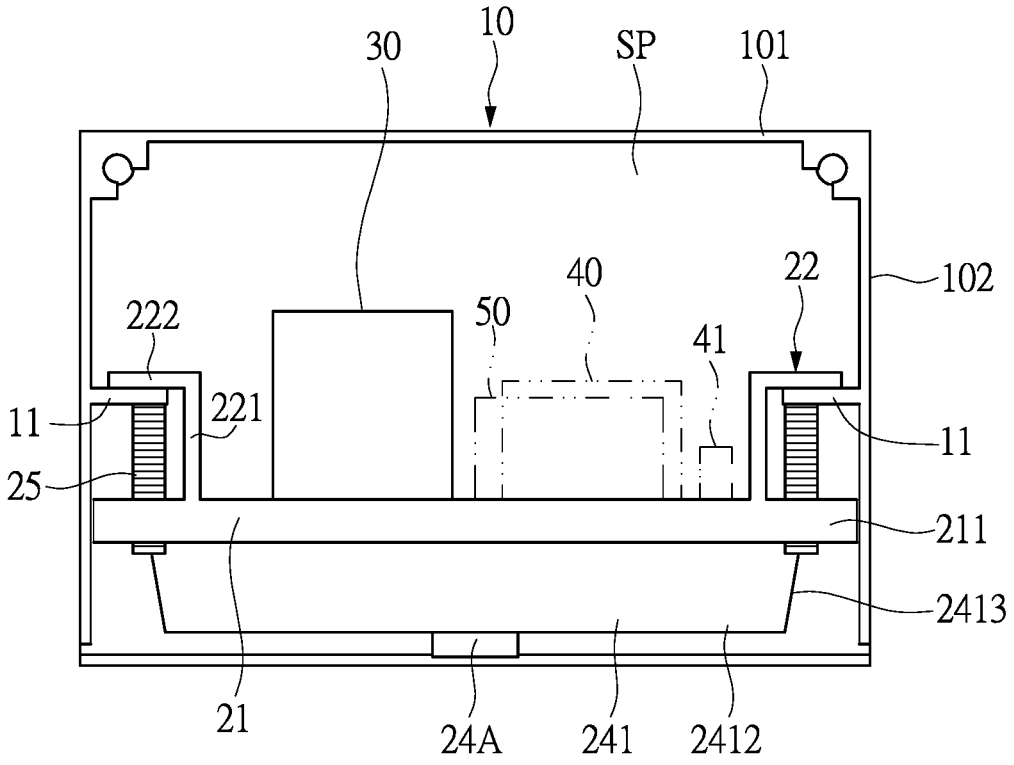
FIG. 7 is a front view of a lamp device without end caps according to the first embodiment of the present disclosure.

Referring to FIG. 2, FIG. 3 and FIG. 7, the lamp device 1 further includes a power module 30 for providing power for the light-emitting units (not shown in the figures). Specifically, the carrier board body 21 and the top wall 101 of the shell 10 collectively form an accommodating space SP. The power module 30 is fixedly disposed on a side of the carrier board body 21 where the connecting members 22 are disposed and is disposed in the accommodating space SP. The carrier board body 21 can be formed with a plurality of wire holes 213 so that electrical connection wires (not shown in the figures) of the light-emitting assemblies 23 can pass through the wire holes 213 and be electrically connected with the power module 30. In other words, after the carrier board body 21 of the lamp device 1 of the present disclosure is disposed in the shell 10, the accommodating space SP for accommodating the power module 30 is formed, so that an extra power supply device does not need to be affixed outside of the lamp device 1.

In certain embodiments, the lamp device 1 can further include a wireless transmission module 40 and a processing module 41. The wireless transmission module 40 and the processing module 41 are electrically connected with the power module 30, and the processing module 41 is electrically connected with the light-emitting assemblies 23 (not shown in the figures). The wireless communication module 40 can receive wireless signals for transmission to the processing module 41, and the processing module 41 can selectively control the light-emitting assemblies 23 and the power module 30 according to the wireless signals. Specifically, the user can transmit wireless signals to the wireless transmission module 40 of the lamp device 1 through a corresponding wireless device (for example, a smartphone, a remote controller or the like), so as to control the opening and closing, brightness, and color temperature of the light-emitting assemblies 23 correspondingly.

In addition, the lamp device 1 can further include a monitoring module 50 and a processing module 41. The monitoring module 50 and the processing module 41 are electrically connected with the power module 30, and the processing module 41 is electrically connected with the light-emitting assemblies 23 (not shown in the figures). The monitoring module 50 is for monitoring the external environment of the lamp device 1. The monitoring module 50 can include, for example, an image capturing unit, a recording unit, and the like. In certain embodiments, related components of the lamp device 1 can be correspondingly provided with through holes, so that components related to the monitoring module 50 (for example, lens, recording units, monitors, Wi-Fi modules, or the like) are exposed outside of the lighting device 1. In certain embodiments, the monitoring module 50 can wirelessly transmit related monitoring information to a network or a specific location for a user to use.

Second Embodiment

Figure 8B:
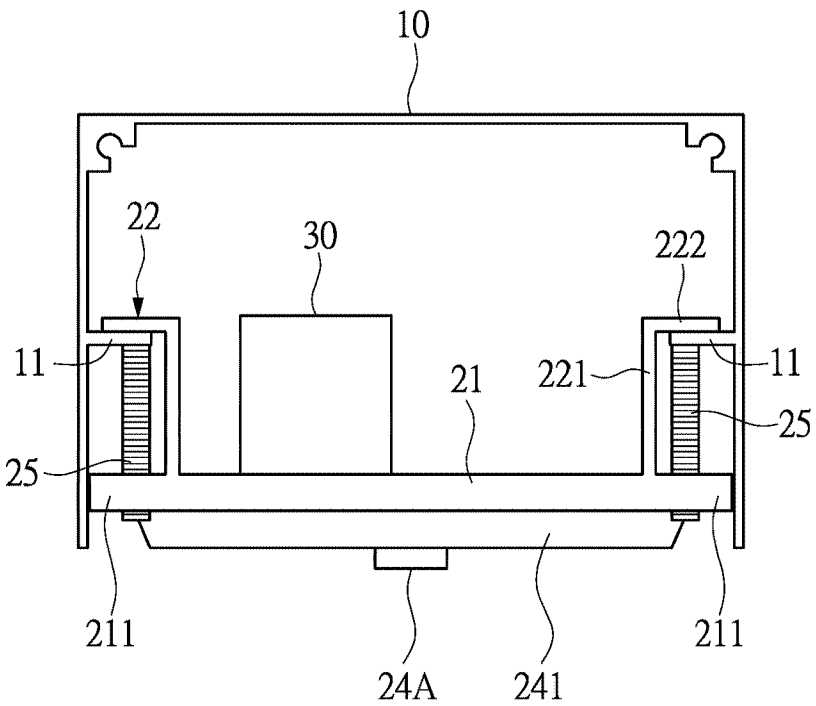
FIGS. 8A and 8B are schematic diagrams of a lamp device according to a second embodiment of the present disclosure.
Figure 8A:
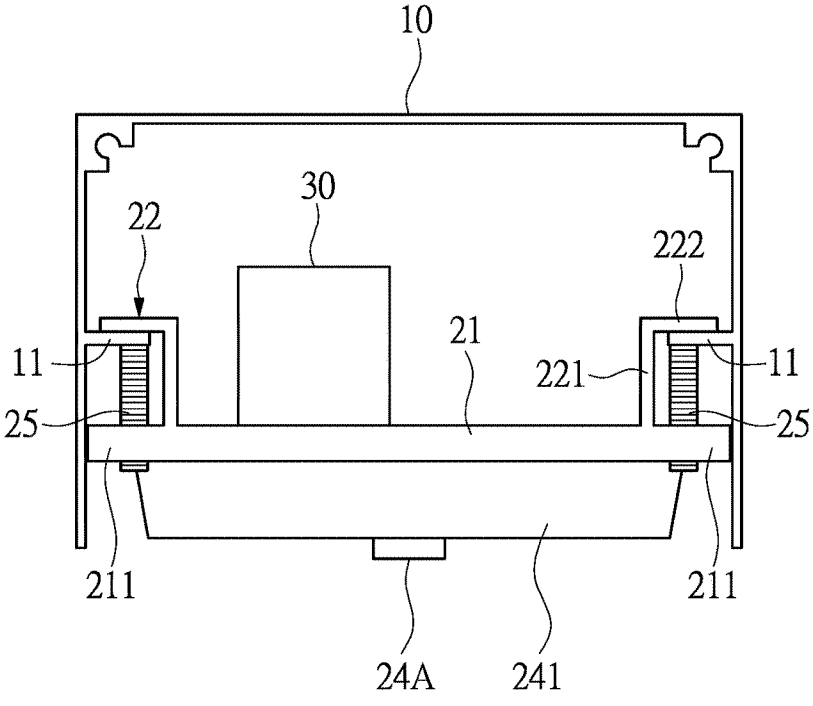

Reference is made both to FIG. 8A and FIG. 8B. FIG. 8A shows a lamp device 1 according to the previous embodiment, and FIG. 8B shows a lamp device 1 according to a second embodiment of the present disclosure. As shown in the figures, through the mutually detachable and combinable relationship between the shell 10 and the light-emitting module 20, a manufacturer or a user can replace lens units 241 of the light-emitting module 20 with those having a different thickness degree according to different needs, without needing to replace the shell 10. More specifically, one of the differences between FIG. 8A and FIG. 8B is that the thickness degree of the lens units 241 of the light-emitting modules 20, and the height of the supporting portions 221 of the connecting member 22 of the carrier board body 21 in FIG. 8B are different from their counterparts in FIG. 8A. That is, after the shell 10 is fixed on a ceiling, when a user intends to replace the light-emitting module 20, the user does not need to detach the entire lamp device 1, instead, through simple steps and methods, only the light-emitting module 20 needs to be replaced.

Third Embodiment

Figure 9:
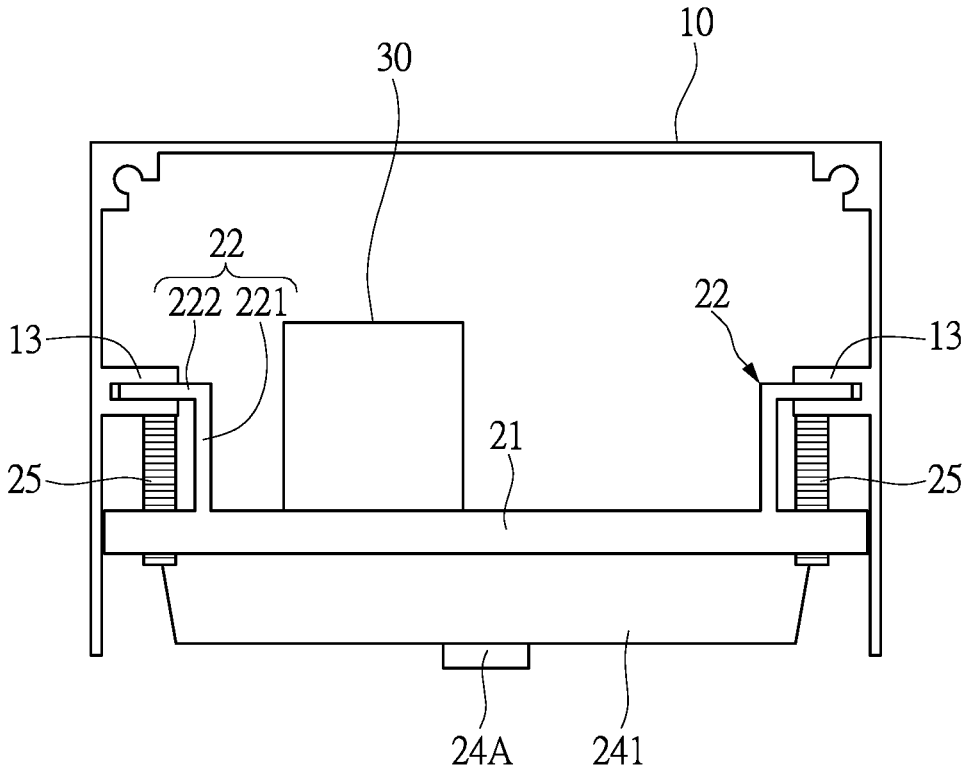
FIG. 9 is a schematic diagram of a lamp device according to a third embodiment of the present disclosure.

Reference is made to FIG. 9, which is a front view of a third embodiment of a lamp device 1 of the present disclosure. As shown in the figure, one of the differences between the present embodiment and the previous embodiments is that the guiding fastener members 13 of the shell 10 can be a guiding track structure, and the connecting portion 222 of the light-emitting module 20 can be correspondingly disposed in the guiding track structure. In other words, the guiding fastener members 13 of the shell 10 are not limited to those configurations shown in the figures of the present disclosure.

Specifically, referring again to FIG. 1 and FIG. 2, in the figures of the present disclosure, the lamp device 1 is exemplified by having two light-emitting modules 20 and two corresponding lens units 241. However, the present disclosure is not limited thereto. The number of the light-emitting modules 20 and the lens units 241 thereof can be increased or decreased according to requirements. Further, the length or width of the shell 10 can be correspondingly changed.

Figure 10:
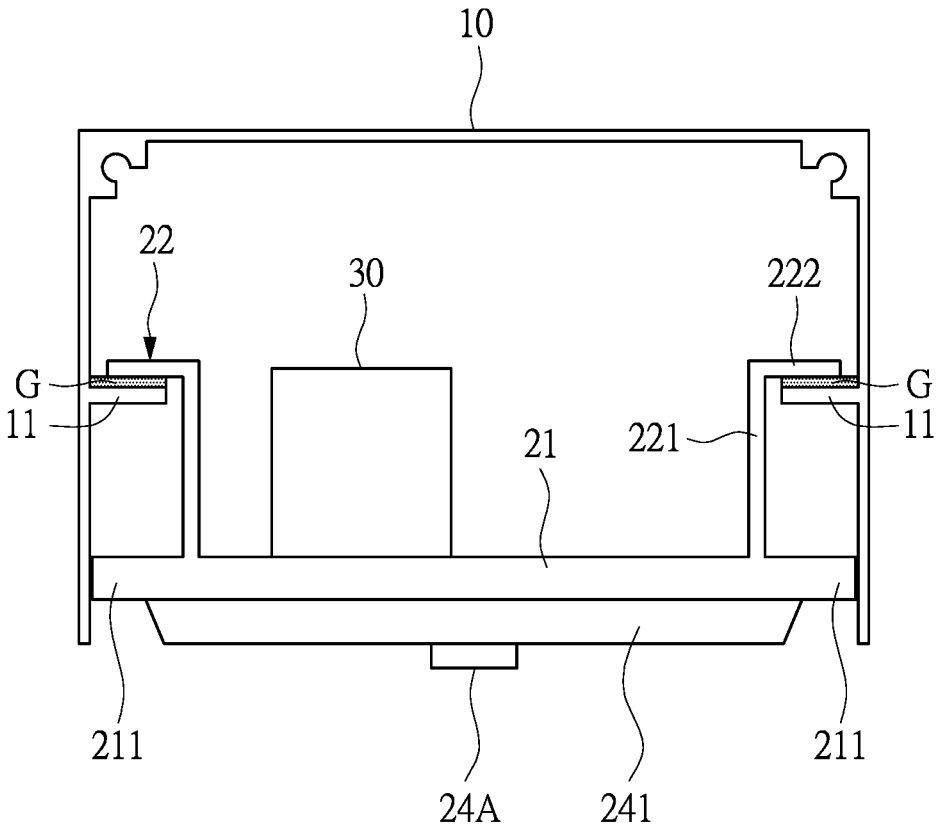
FIG. 10 is a schematic diagram of a lamp device according to another embodiment of the present disclosure.

In particular, as shown in FIG. 10, in certain embodiments, the two connecting portions 222 of the light-emitting module 20 and the two guiding fastener members 11 are fixed to each other through a gluing member G, rather than the fastening members 25 in the foregoing embodiments. The glue component G can vary according to the material of the two connecting portions 222 and the material of the two guide fastener members 11, and is not limited herein.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A lamp device, comprising:

a shell, having a top wall having two opposite side edges; and two side walls disposed respectively at the two opposite side edges and opposite to each other, each side wall having a surface facing the other side wall;

two guiding fastener members respectively disposed at the two surfaces of the two side walls, each being a long-strip board structure; and at least one light-emitting module, selectively and fixedly disposed in the shell, configured to move along a central axis of the two guiding fastener members, and including:

a carrier board body having two opposite side edges, a plurality of fastening holes formed on each of the two side edges of the carrier board body, and a wide lateral surface;

two connecting members, formed on the wide lateral surface, extending along a direction away from the carrier board body, and respectively disposed adjacent to the two side edges of the carrier board body, each having:

a connecting portion configured to move relative to the shell along the central axis of the two guiding fastener members; and a supporting portion connected with a corresponding guiding fastener member and having two ends respectively connected with the wide lateral surface and the connecting portion;

a plurality of fastening members, correspondingly fastened in the fastening holes, each having an end configured to, when the fastening member is fastened in a corresponding fastening hole, abut against a surface facing away from the top wall of a corresponding guiding fastener member, so that the carrier board body is fixedly disposed in the shell;

a plurality of light-emitting assemblies fixedly disposed on a first surface of the carrier board body opposite to a second surface of the carrier board body where the connecting members are disposed; and at least one light-permeable shield module, fixedly disposed on the first surface of the carrier board body where the light-emitting assemblies are disposed, and configured to correspondingly shield the light-emitting assemblies, wherein when the connecting portions of the connecting members are connected with the guiding fastener members, the guiding fastener members shield the fastening holes.

2. The lamp device according to claim 1, wherein the light-permeable shield module further includes a plurality of lens units corresponding to the light-emitting assemblies and is configured to correspondingly cover on the light-emitting assemblies so that lights emitted by the light-emitting assemblies correspondingly emerge from the lens units; and wherein when the light-emitting module is fixedly disposed in the shell, a light emergent surface of each lens unit is not exposed from a plane defined by ends away from the top wall of the two side walls.

3. The lamp device according to claim 2, further comprising a plurality of mounting members, the lens units being formed with a first plurality of mounting holes corresponding to a second plurality of mounting holes formed on the carrier board body, and the mounting members being configured to cooperate with the first and second pluralities of mounting holes to fix the lens units on the carrier board body.

4. The lamp device according to claim 1, wherein when the light-emitting module is fixedly disposed in the shell, a surface of each connecting portion abuts against a surface facing the top wall of a corresponding guiding fastener member.

5. The lamp device according to claim 1, wherein the top wall is formed with a plurality of top wall fastening holes at the two side edges thereof, and two ends of the carrier board body are formed with a plurality of avoidance holes corresponding to the top wall fastening holes;

wherein when the light-emitting module is fixedly disposed in the shell, the fastening members pass through the avoidance holes and are correspondingly fastened in the top wall fastening holes, so that the shell is fixedly disposed on a wall surface; and wherein the lamp device further includes two end caps fixedly disposed on two ends of the shell, each of the end caps having a shielding portion configured to correspondingly shield adjacent avoidance holes.

6. The lamp device according to claim 1, each light-emitting assembly further including:

a substrate fixedly disposed on the first surface of the carrier board body; and a plurality of light-emitting units fixed disposed on the substrate, wherein the carrier board body is a heat-conducting structure, and thermal energy generated by operation of the light-emitting units are conducted away through the carrier board body.

7. The lamp device according to claim 1, wherein the light-emitting module is fixedly disposed in the shell, the carrier board body and the top wall of the shell form an accommodating space, the lamp device further includes a power module fixedly disposed at the second surface of the carrier board body and disposed in the accommodating space, and the carrier board body is formed with a plurality of wire holes through which electrical connection wires of the light emitting assemblies pass to be electrically connected with the power module.

8. The lamp device according to claim 7, further comprising a wireless transmission module and a processing module both electrically connected with the power module, the processing module being electrically connected with the light-emitting assemblies, the wireless transmission module being configured to receive at least one wireless signal and transmit the wireless signal to the processing module, and the processing module being configured to selectively control the light-emitting assemblies and the power module according to the wireless signal.

9. The lamp device according to claim 7, further comprising a monitoring module and a processing module both electrically connected with the power module, the processing module being electrically connected with the light-emitting assemblies, and the monitoring module being configured to monitor an external environment of the lamp device.

10. A lamp device, comprising:

a shell, having a top wall having two opposite side edges; and two side walls disposed respectively at the two opposite side edges and opposite to each other, each side wall having a surface facing the other side wall;

two guiding fastener members respectively disposed at the two surfaces of the two side walls, each being a long-strip board structure; and at least one light-emitting module, selectively and fixedly disposed in the shell, configured to move along a central axis of the two guiding fastener members, and including:

a carrier board body having two opposite side edges and a wide lateral surface;

two connecting members, formed on the wide lateral surface, extending along a direction away from the carrier board body, and respectively disposed adjacent to the two side edges of the carrier board body, each having:

a connecting portion configured to move relative to the shell along the central axis of the two guiding fastener members; and a supporting portion connected with a corresponding guiding fastener member and having two ends respectively connected with the wide lateral surface and the connecting portion;

a plurality of light-emitting assemblies fixedly disposed on a surface of the carrier board body opposite to a surface of the carrier board body where the connecting members are disposed; and at least one light-permeable shield module, fixedly disposed on the surface of the carrier board body where the light-emitting assemblies are disposed, and configured to correspondingly shield the light-emitting assemblies, wherein the two connecting portions of the connecting members are correspondingly fastened with the guiding fastener members through a gluing member.

* * * * *